United States Patent [19]

Suzuki

[11] 4,231,566

[45] Nov. 4, 1980

[54] SHEET FEED APPARATUS

[75] Inventor: Minoru Suzuki, Yokohama, Japan

[73] Assignee: Ricoh Company, Ltd., Japan

[21] Appl. No.: 964,888

[22] Filed: Nov. 30, 1978

[30] Foreign Application Priority Data

Nov. 30, 1977 [JP] Japan ..... 52-144479

[51] Int. Cl.[3] ..... B65H 3/06; B65H 1/18

[52] U.S. Cl. ..... 271/117; 221/231; 221/242; 271/126; 271/155; 271/157; 271/164; 271/170; 271/171; 414/123; 414/900

[58] Field of Search ..... 271/117, 126, 164, 162, 271/171, 170, 157, 109, 118, 127, 124, 152–155; 221/241, 242, 231, 198; 414/123, 900

[56] References Cited

U.S. PATENT DOCUMENTS

| | | | |
|---|---|---|---|
| 3,647,207 | 3/1972 | McPherson | 271/164 |
| 3,768,805 | 10/1975 | Kuksa | 271/126 |
| 4,098,501 | 7/1978 | Tani et al. | 271/117 |

*Primary Examiner*—Bruce H. Stoner, Jr.

*Attorney, Agent, or Firm*—McGlew and Tuttle

[57] ABSTRACT

A sheet feed apparatus for use with a copying machine comprising a sheet stacking member for stacking recording sheets thereon, and a pair of sheet feed rollers for feeding the recording sheets one by one, which are arranged coaxially on a driving shaft disposed above the sheet stacking member, and one sheet feed roller is located at an appropriate position and the other sheet feed roller is movable along the driving shaft. The sheet stacking member can take two positions, a sheet feed position and a sheet replenishment position, by sliding the sheet stacking member in and out of the body of the copying machine. When the sheet stacking member is slid out of the body of the copying machine to the sheet replenishment position and recording sheets are stacked on the sheet stacking member and then slid into the body of the copying machine, the position of the movable sheet feed roller is automatically determined appropriately in accordance with a partition plate which is to be set in accordance with the size of the recording sheets.

18 Claims, 17 Drawing Figures

SHEET FEED APPARATUS

BACKGROUND OF THE INVENTION

The present invention relates to a sheet feed apparatus for use with copying apparatus.

For example, in a copying machine, when recording sheets with different sizes, such as A series sizes and B series sizes, are selectively used, it will be better to install a sheet feed apparatus capable of feeding the recording sheets of various sizes in the copying machine rather than to install several sheet feed apparatuses for use with the recording sheets of different sizes, in view of making the copying machine compact in size.

However, in the case where the recording sheets of various sizes are fed from one sheet feed apparatus, the most difficult point is to set a sheet feed roller at the most proper position in accordance with the size of each recording sheet.

Conventionally, as an example of the sheet feed apparatus capable of feeding the recording sheets of different sizes, a one-side line-up system is known, in which the feeding direction of the recording sheets is determined by utilizing one side of the recording sheets as a standard line. In the one-side line-up system, on the side of a standard line, there is disposed one sheet feed roller, and on the other side, there are disposed two sheet feed rollers (i.e., an inner roller and an outer roller). These sheet feed rollers are arranged coaxially, and the recording sheets of A sizes are fed by the sheet feed roller on the standard line side and by the inner roller, while the recording sheets of B sizes are fed by the sheet feed roller on the standard line side and the outer roller. However, when the recording sheets of B sizes are fed, the three rollers including the inner roller are used. Therefore, a non-uniform feeding force is applied to the opposite sides of the recording sheets of B sizes by the three rollers. Therefore, the conventional system has a disadvantage of frequently causing a skew in the feeding of recording sheets and the images on the recording sheets are deformed.

In an apparatus belonging to the one-side line-up system, a first sheet feed roller on the standard line side is fixedly mounted on a shaft, and a second sheet feed roller is mounted on the shaft so as to be movable in the axial direction of the shaft, and the second sheet feed roller is moved appropriately in the axial direction of the shaft in accordance with the size of the recording sheets. The second sheet feed roller is moved manually whenever the recording sheets of different sizes are employed. However, it is not easy to move the second sheet feed roller since it is positioned inside the body of a copying machine.

SUMMARY OF THE INVENTION

It is therefore a primary object of the present invention to provide a sheet feed apparatus wherein, when a sheet feed base is caused to slide out of the body of a copying machine and a stack of recording sheets are placed on the sheet feed base and the sheet feed base is returned into the body of the copy machine, the position of a sheet feed roller is automatically determined in accordance with the size of the recording sheets placed on the sheet feed base.

The object of the present invention is attained by a sheet feed apparatus comprising a first sheet feed roller fixed to a sheet feed roller driving shaft, a second sheet feed roller mounted on said sheet feed roller driving shaft, the second sheet feed roller being rotatable integrally with the sheet feed roller driving shaft and selectively movable along the sheet feed roller driving shaft, a recording sheet feed base for stacking recording sheets of various sizes thereon, the recording sheet feed base being disposed under the sheet feed roller driving shaft and movable parallel to said sheet feed roller driving shaft, guide means for guiding the recording sheet feed base so that the recording sheet stacking base can take a sheet feed position and a sheet replenishment position, and means for moving the second sheet feed roller along the sheet feed roller driving shaft in accordance with the size of the recording sheets stacked on the recording sheet feed base.

According to the present invention, since the position of the second sheet feed roller is automatically set in accordance with the size of the recording sheets stacked on the recording sheet stacking base, a uniform feeding force is always properly applied to the recording sheets to be fed and a sheet feeding without any skew in the recording sheets is attained.

BRIEF DESCRIPTION OF THE DRAWINGS

For a better understanding of the invention as well as other object and further feature thereof, reference is had to the following detailed description of the invention to be read in connection with the accompanying drawings, wherein.

DETAILED DESCRIPTION OF PREFERRED EMBODIMENTS

Figure 1:
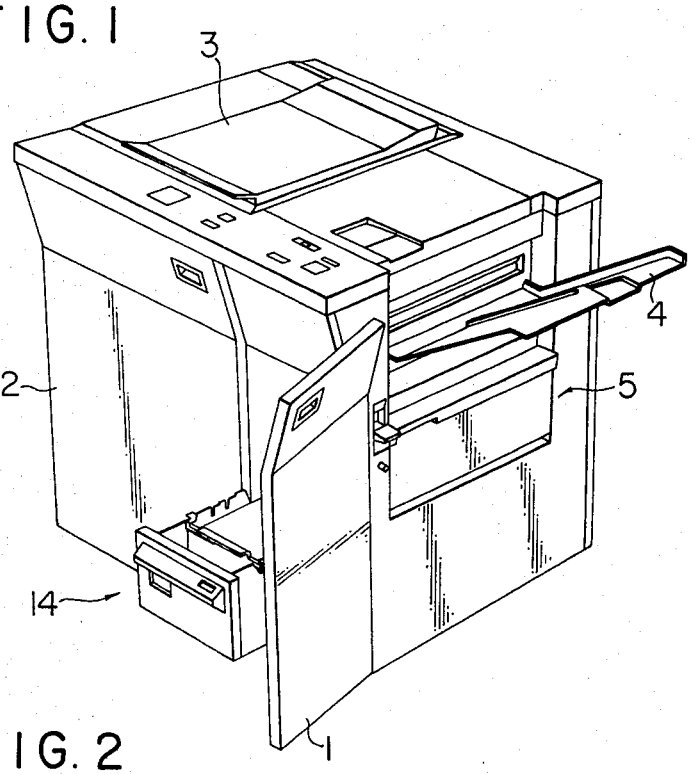
FIG. 1 is a schematic perspective view of a copying machine employing a sheet feed apparatus according to the present invention, wherein a sheet feed basis drawn out to a sheet replenishment position.

Referring to FIG. 1, there is shown perspectively a copying machine employing an embodiment of a sheet feed apparatus according to the present invention. On the front side of the copying machine, there are provided a pair of doors 1 and 2 which can be opened to the front side of the copying machine. On an upper portion of the copying machine, there is provided a pressure plate 3, and on a side portion of the copying machine, there are provided a sheet outlet tray 4 and a cassette holding apparatus 5. The sheet feed apparatus according to the present invention is installed in the body of the copying machine by opening the door 1.

Figure 2:
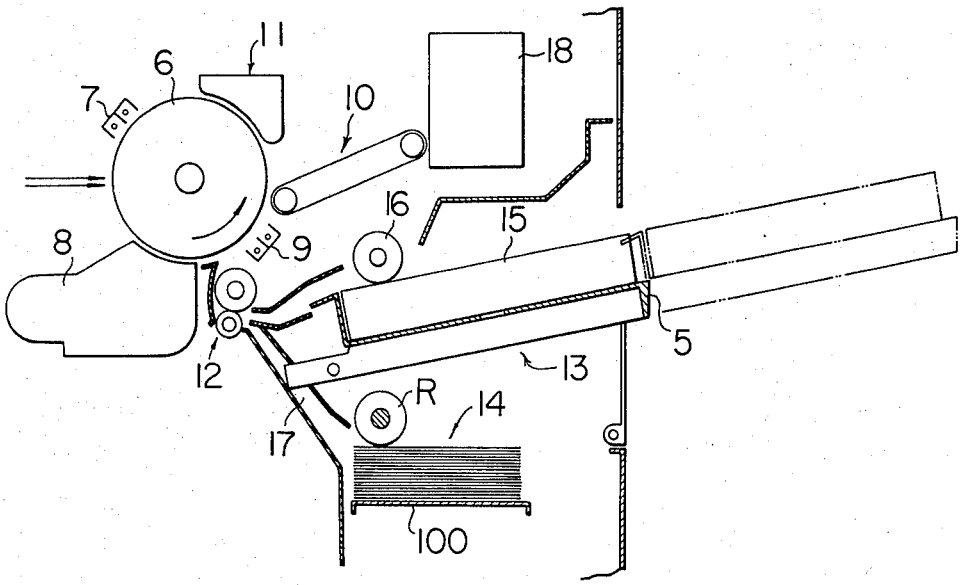
FIG. 2 is a schematic partial sectional side view of the copying machine of FIG. 1.

Referring to FIG. 2, the outline of the mechanism of the copying machine will now be explained. In the figure, reference numeral 6 represents a photoconductor drum which is rotated in the direction of the arrow. Around the photoconductor drum 6, there are arranged a charging apparatus 7, a development apparatus 8, an image transfer apparatus 9, a recording sheet separation and transportation apparatus 10 and a cleaning apparatus 11. Reference numeral 18 indicates an image fixing apparatus. To a portion of the surface of the photoconductor drum 6 between the charging apparatus 7 and the development apparatus 8, there is projected a light image of an original by an exposure optical system (not shown). Between the development apparatus 8 and the image transfer apparatus 9, there are disposed a pair of register rollers 12, to which a recording sheet is selectively fed from a first sheet feed apparatus 13 or a second sheet feed apparatus 14. The first sheet feed apparatus 13 is for feeding the recording sheets from a cassette 15 by a sheet feed roller 16. The cassette 15 is placed in the cassette holding apparatus 5 which is detachable from the body of the copying machine.

The second sheet feed apparatus 14 is a subject of the present invention. As shown in FIG. 1, the second sheet feed apparatus 14 slides in and out of the front side of the copying machine. When the second sheet feed apparatus 14 is pushed from a recording sheet replenishment position to a predetermined sheet feed position in the copying machine as shown in FIG. 1, a recording sheet is fed into the register rollers 12 from a sheet feed path 17. The second sheet feed apparatus 14 will be explained later in more detail.

Roughly speaking, the sheet feed apparatus according to the present invention comprises sheet feed roller means R which is disposed inside the copying machine and a sheet feed base 100 which slides in and out of the copying machine.

Figure 3:
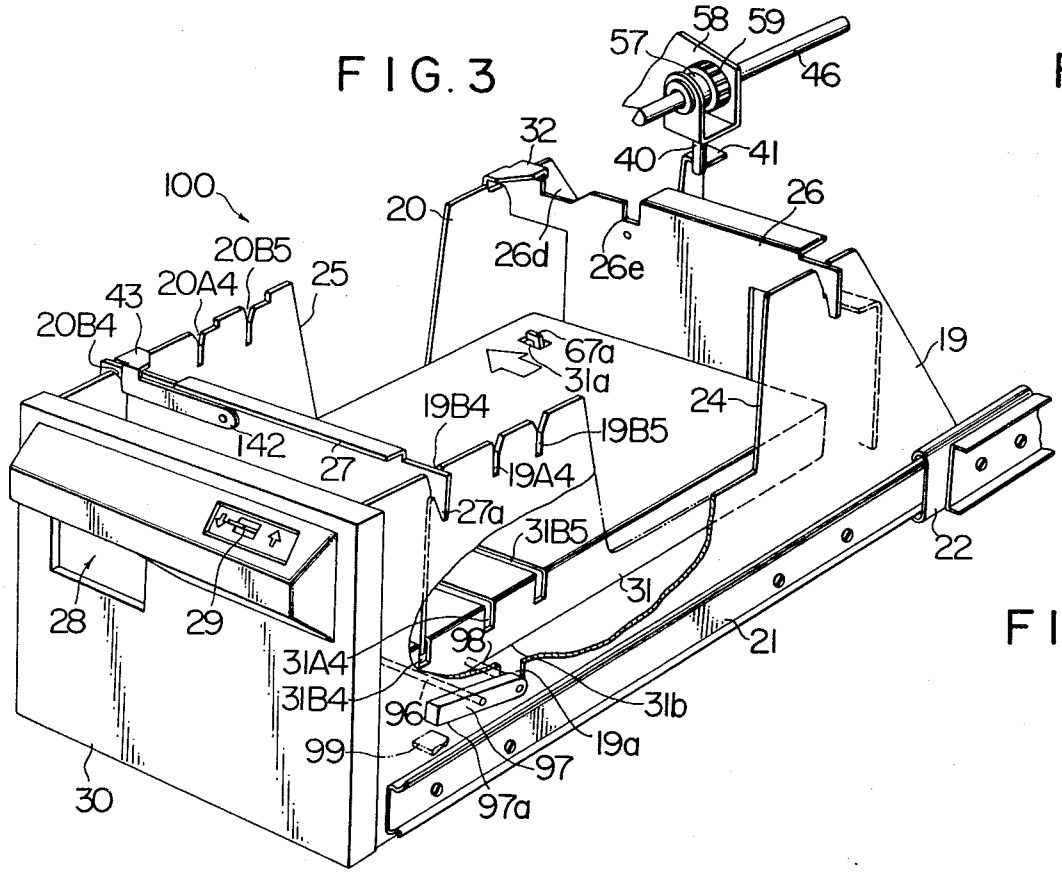
FIG. 3 is a schematic perspective and partially cutaway view of the sheet feed base of FIG. 1.

First of all, the sheet feed base 100 will be explained. Referring to FIG. 3, to the lower portion of each of side plates 19 and 20, there is fixed a slide rail 21 (only one slide rail 21 is shown in FIG. 3). The slide rail 21 is slidably engaged with a fixed rail 22 (only one fixed rail 21 is shown in FIG. 3) which is fixed to the body of the copying machine. Accordingly, the sheet feed base 100 is slidable along the rails 21 and 22 in and out of the copying machine.

Between the side plates 19 and 20, there is disposed a recording sheet stacking base 31, which is vertically movable. Notches 24 and 25 are formed on the side plates 19 and 20, respectively. The notches 24 and 25 allow the fingers of the operator to pass therethrough when the recording sheets are stacked on the recording sheet stacking base 31. At the back end portions of the side plates 19 and 20, there is disposed a fixed partition plate 26 for abutting thereagainst a reference end of a stack of the recording sheets to be placed on the sheet stacking base 31.

In the upper edge of the side plate 19, there are formed notches 19B5, 19A4, and 19B4 for setting the position of a movable partition plate 27 which serves to set the position of the recording sheets on the recording sheet stacking base 31 in accordance with a desired size of the recording sheets. The notches 19B5, 19A4 and 19B4 respectively correspond to the sizes B5 (182 mm ×257 mm), A4 (210 mm ×297 mm) and B4 (257 mm ×364 mm) of the recording sheets. Also in the upper edge of the side plates 20, there are formed notches 20B5, 20A4 and 20B4, which respectively correspond to the noches 19B5, 19A4 and 19B4. In each of the notches 20B5, 20A4 and 20B4, there is formed a stepped portion into which a corner separator 43 provided at the movable partition plate 27 can be dropped.

On the front side panel 30 of the sheet feed base 100, there are provided a catching portion 28 for pulling out the sheet feed base 100 manually to the front side of the copying machine and an operation switch 29 for actuating a motor 93 (refer to FIG. 8) for lifting the recording sheet stacking base (31) up and down.

Figure 4:
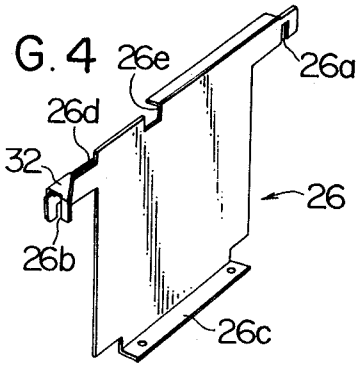
FIG. 4 is a schematic perspective view of a fixed partition plate of the sheet feed apparatus of FIG. 1.
Figure 6:
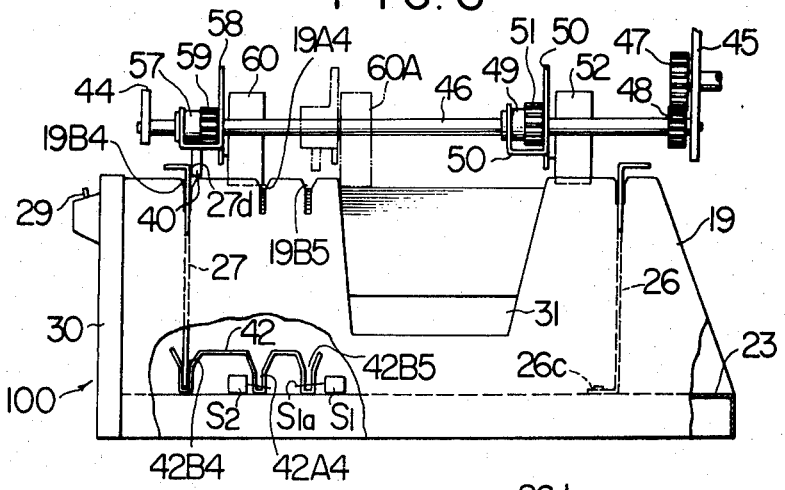
FIG. 6 is a schematic side view of a first sheet feed roller and a second sheet feed roller and the sheet feed base of the sheet feed apparatus of FIG. 1 for showing their configuration when the sheet feed base is in a sheet feed position.
Figure 7:
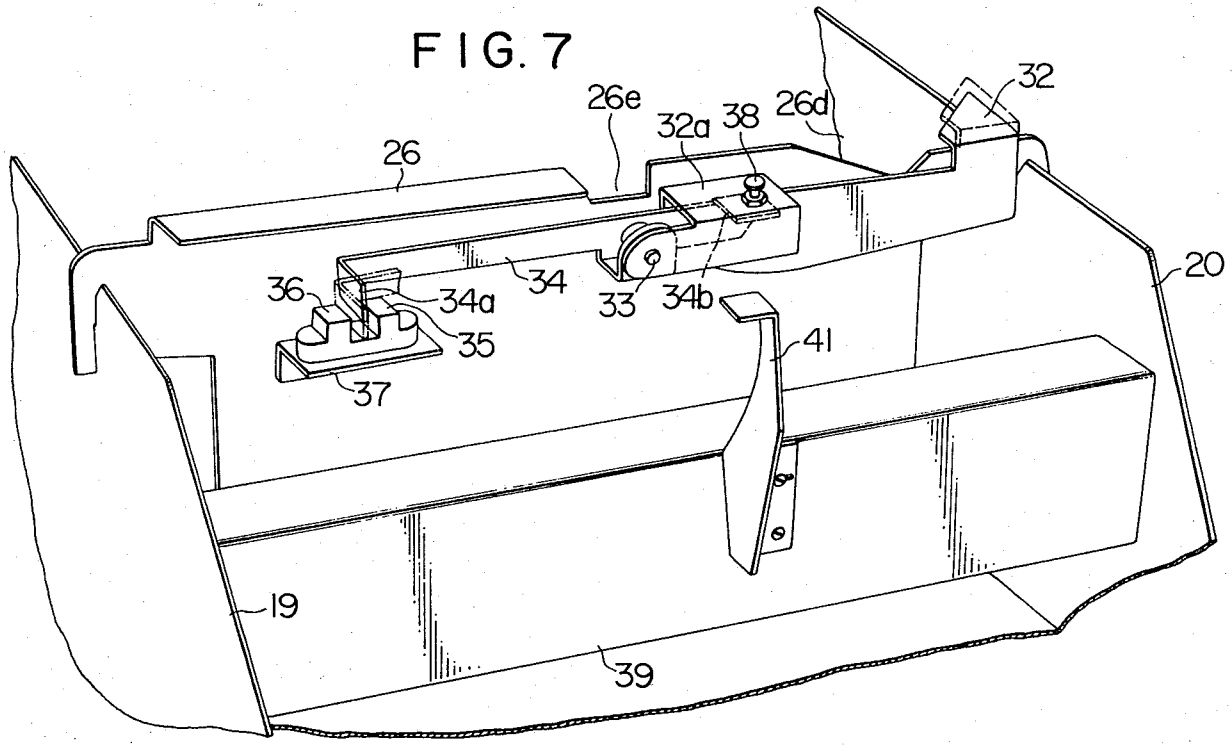
FIG. 7 is a schematic perspective view of a recording sheet level detecting mechanism for use in the sheet feed apparatus of FIG. 1.

Referring to FIGS. 4 and 6, the fixed partition plate 26 is fixed to the side plates 19 and 20 and a base 23 by engaging portions 26*a* and 26*b* formed on opposite upper ends of the fixed partition plate 26 with the corresponding engagement portions of the respective two side plates 19 and 20, and by fixing a bent portion 26*c* formed at the lower end of the fixed partition plate 26 to the base 23. On an upper end portion of the fixed partition plate 26, there are formed escape notches 26*d* and 26*e* for preventing a sheet feed roller and a pin for moving the sheet feed roller from being engaged with the fixed partition plate 26. The details of the sheet feed roller will be described later. On one upper end of the fixed partition plate 26, there is arranged a corner separator 32. As shown in FIG. 7, a base portion of the corner separator 32 is pivotally mounted on a pin 33 at the back side of the fixed partition plate 26.

On the pin 33, there is pivotally mounted a recording sheet level detecting arm 34, which is constructed so that a tip portion 34*a* of the recording sheet level detecting arm 34 can be positioned between a light emitting element 35 and a light receiving element 36 which faces each other under the weight of the recording sheet level detecting arm 34 or by a bias of a spring means (not shown). Both elements 35 and 36 are fixed to the fixed partition plate 26 through an attachment member 37. One end 34*b* of the recording sheet level detecting arm 34 is urged so as to be brought into contact with a lower surface of a bent portion 32*a* of the corner separator 32.

At the bent portion 32*a* of the corner separator 32, there is provided a fine adjustment screw 38 (refer to FIG. 7).

Figure 8:
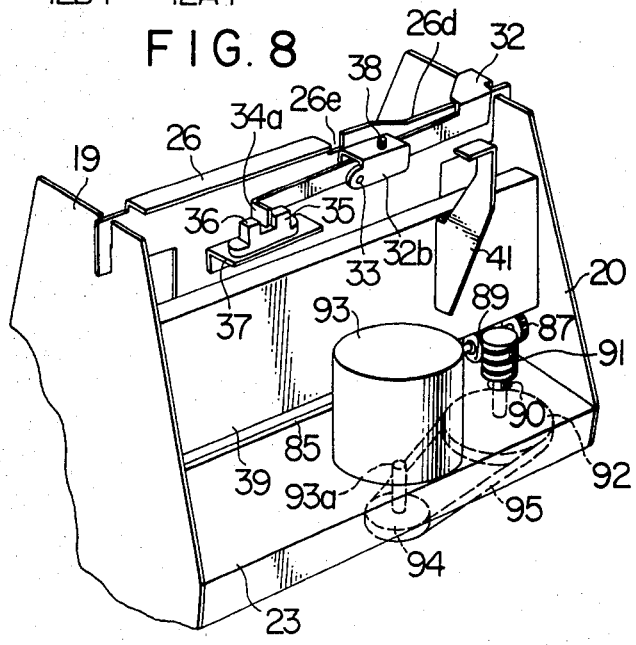
FIG. 8 is a schematic perspective view of the back side of the sheet feed base of the sheet feed apparatus of FIG. 1.

In FIGS. 7 and 8, the side plates 19 and 20 are bridged by a stay 39, and to the stay 39, there is fixed an engagement arm 41 which is engaged with a pin 40 for moving a second sheet feed roller 60 (refer to FIG. 3), which will be described later in detail.

Figure 5:
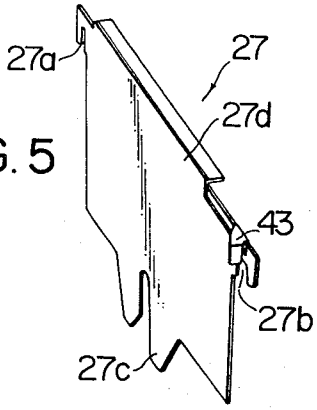
FIG. 5 is a schematic perspective view of a movable partition plate of the sheet feed apparatus of FIG. 1.

Referring to FIG. 5, in the opposite upper ends of the movable partition plate 27, there are formed an engagement portion 27*a* with which the notches of the side plate 19 can be engaged, and an engagement portion 27*b* with which the notches of the side plate 20 can be engaged.

In the lower end of the movable partition plate 27, there is formed a register leg 27*c* which can be inserted selectively into register slits 31B5, 31A4, and 31B4 formed in the recording sheet stacking base 31 and can fit a receiving member 42 (refer to FIG. 6) fixed to the base 23. On one upper side of the movable partition plate 27, there is pivotally mounted on a pin 142 a corner separator 43, which constitutes the counterpart of the corner separator 32. The partition plate 27 is detachably mounted on the side plates 19 and 20, and in accordance with the size of the recording sheets to be stacked on the recording sheet stacking base 31, the engagement position of the partition plate 27 in the side plates 19 and 20 can be determined.

Figure 10:
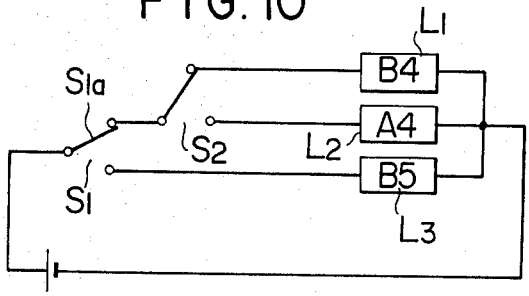
FIG. 10 is a diagram of the circuits of a recording sheet size detecting switch of the sheet feed apparatus of FIG. 1.

The receiving member 42 in which the register leg 27*c* of the partition plate 27 can be fitted is fixed to the base 23 as shown in FIG. 6, and in the receiving member 42, there are formed holding bent portions 42B5, 42A4 and 42B4 corresponding to the respective notches of the side plate 19. In the holding bent portions 42B5 and 42A4, there are respectively disposed recording sheet size detecting switches S1 and S2 having actuators, respectively. The recording sheet size detecting switches S1 and S2 comprise switches biased so as to close in one direction as show in FIG. 10. When the movable partition plate 27 is set at the B4 size, a display lamp L1 is lighted, and the size is displayed on a display panel (not shown) of the copying machine. For example, when B5 size recording sheets are stacked on the sheet stacking base 31 and the partition plate 27 is set at the B5 size position and the register leg 27*c* depresses an actuator S1*a* of the recording sheet size detecting switch S1, a display lamp L3 is lighted so that the size of the set recording sheet is displayed. As a matter of course, when A4 size recording sheets are stacked on the sheet stacking base 31, a display lamp L2 is lighted. The display lamps L1, L2 and L3 are disposed in a display panel (not shown) of the copying machine for displaying the size of the recording sheets set.

In FIG. 6, a driving shaft 46 for driving the sheet feeding rollers 52 and 60 is rotatably supported by fixed side plates 44 and 45 of the body of the copying machine. To one end of the driving shaft 46 is fixed a gear 48 which is engaged with a gear 47 of a driving apparatus (not shown).

Figure 11:
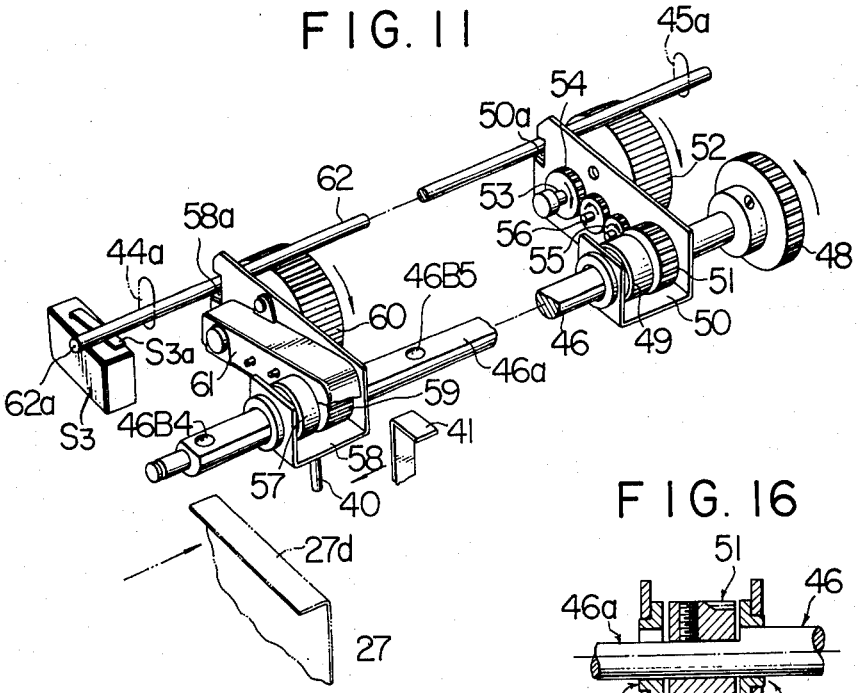
FIG. 11 is a schematic perspective view of the first sheet feed roller and the second sheet feed roller of the sheet feed apparatus of FIG. 1.
Figure 16:
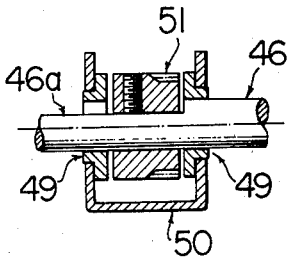
FIG. 16 is a schematic sectional side view of the first sheet feed roller which is attached to the driving shaft of the sheet feed apparatus according to the present invention.

Referring to FIG. 11, part of the peripheral surface of the driving shaft 46 is cut so as to form a key surface 46*a*. On one end of the driving shaft 46, there are mounted an arm 50 through a bearing 49 which is rotatable on the driving shaft 46, and a gear 51 which is fixed to the driving shaft 46 by a screw so as to be rotatable integrally with the driving shaft 46 (refer to FIG. 16). The gear 51 does not move in the axial direction of the driving shaft 46. In a top portion of the arm 50, the first sheet feed roller 52 is fixed to a shaft 53. On the shaft 53, there is mounted a gear 54 through a one-way clutch (not shown). Between the gear 54 and the gear 51, there are arranged intermediate gears 55 and 56. Therefore, the first sheet feed roller 52 is immovable in the axial direction of the shaft 53, but can be rotated integrally with the driving shaft 46 through a gear train consisting of the gears 54, 56, 55 and 51.

Figure 17:
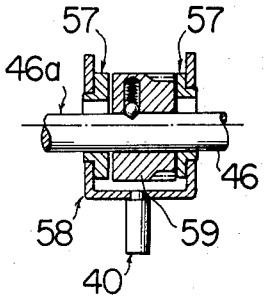
FIG. 17 is a schematic sectional side view of the second sheet feed roller which is attached to the driving shaft of the sheet feed apparatus according to the present invention.

On the driving shaft 46, there are mounted an arm 58 through a bearing 57 which is rotatable on the driving shaft 46 and also movable in the axial direction of the driving shaft, and a gear 59 which is rotatable integrally with the driving shaft 46 and movable in the axial direction of the driving shaft 46 (refer to FIG. 17). The second sheet feed roller 60 is rotatably mounted on a top portion of the arm 58. The second feed roller 60 is rotated by a gear train which is similar to the gear train for rotating the first sheet feed roller 52. The gear train for rotating the second feed roller 60 is covered with a cover 61. The gear train provided at the arm 50 is also covered by a cover as in the case of the gear train for use with the second sheet feed roller 60. However, in FIG. 11, the cover for the arm 50 is detached for a better understanding of the gear train provided at the arm 50. To a lower end surface of the arm 58, there is fixed a pin 40 extending downwards for moving the second sheet feed roller 60 in the axial direction of the driving shaft 46. In the gear 59, there is provided a ball which is pushed against the driving shaft 46 by spring means. The ball fits selectively the counter sinks 46B4 or 46B5 for click stop formed on the driving shaft 46 so that the gear 59 is stopped in accordance with the size of the recording sheets.

In the top portions of the arms 50 and 58, there are respectively formed guide notches 50*a* and 58*a*. In these guide notches 50*a* and 58*a*, a guide rod 62 is loosely fitted. The opposite ends of the guide rod 62 are supported in slots 44*a* and 45*a* formed in the fixed side plates 44 and 45 (refer to FIG. 6) in such a manner that the guide rod 62 can be moved vertically. Normally, the guide rod 62 is supported on the lower end portions of the slots 44*a* and 45*a* under the weight of the arms 50 and 58.

An actuator S3*a* of a safety switch S3 fixed to the fixed side plate 44 is in contact with the lower side of one end of the guide rod 62. The switch S3 is closed, for instance, when the guide rod 62 is positioned at the lowest portion of the slot 44*a*, and when the guide rod 62 is moved upwards, the switch S3 is opened and a motor 93 for lifting the sheet stacking base 31 up and down is deenergized, whereby the upward movement of the sheet stacking base 31 is stopped, and at the same time, the stopping of the upward movement of the sheet stacking base 31 is displayed on a display panel (not shown) of the copying machine by an electric circuit comprising the switch S3. The operation of the switch S3 will be described later in more detail.

When the sheet feed base 100 is pulled to the recording sheet replenishment position, the pin 40 for moving the second sheet feed roller 60 to the axial direction of the driving shaft 46 is engaged with an engagement arm 41 (refer to FIG. 3), and when the sheet feed base 100 is pushed up to the sheet feed position, the pin 40 is engaged with a shoulder portion 27*d* of the movable partition plate 27 (refer to FIG. 6).

Figure 9:
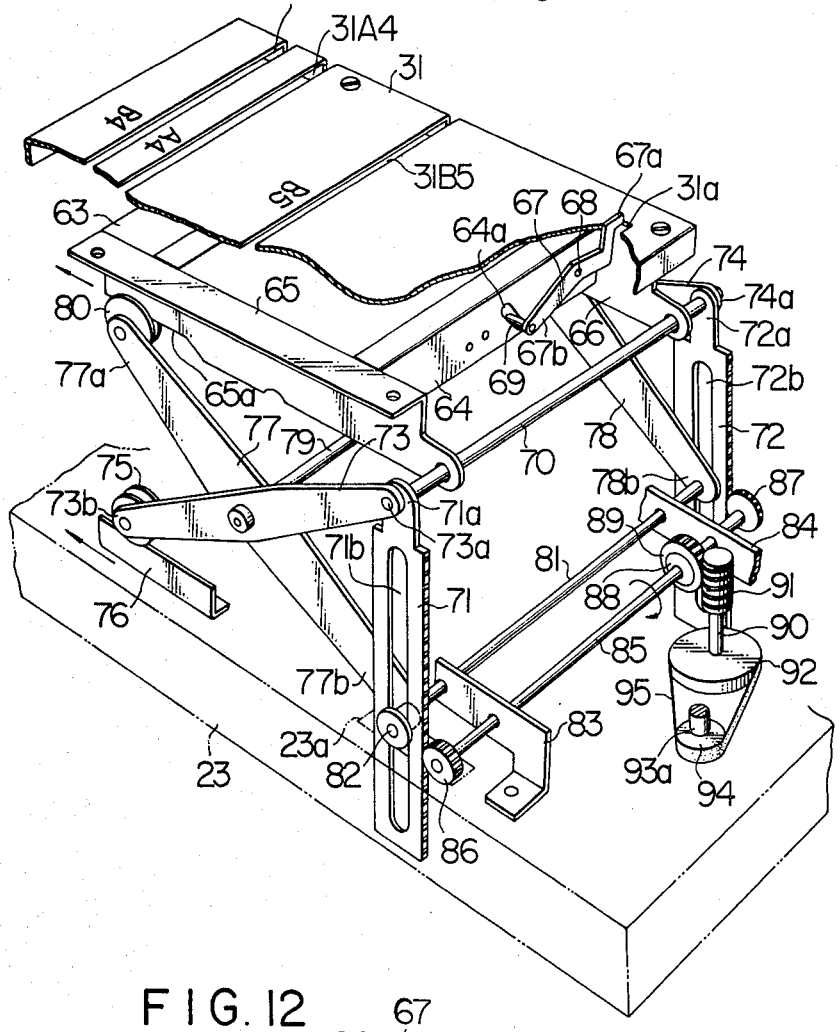
FIG. 9 is a schematic partially cutaway perspective view of a lifting mechanism of a recording sheet stacking base of the sheet feed apparatus of FIG. 1.

Referring to FIG. 9, the sheet stacking base 31 will now be described. The sheet stacking base 31 is screwed on a pair of frames 65 and 66 which are connected to stays 63 and 64. On the stay 64, there is pivotally mounted a sheet existence detecting lever 67 by a pin 68. One end 67*a* of the sheet existence detecting lever 67 is projected upwards through a hole 31*a* formed in the sheet stacking base 31 under the weight of the lever 67 or by a bias of an actuator of a switch which will be described later (refer to FIG. 3). A pin 69 is fixed to the other end 67*b* of the sheet existence detecting lever 67 and is inserted into a slot 64*a* formed on the stay 64 and is projected from the back side of the stay 64.

Figure 12:
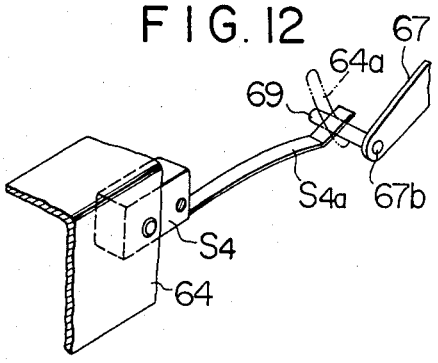
FIG. 12 is a schematic perspective view of a recording sheet detection switch of the sheet feed apparatus of FIG. 1.

Referring to FIG. 12, a sheet existence detecting switch S4 is attached to the back side of the stay 64 and one end of an actuator S4*a* of the switch S4 is in contact with the upper side of the pin 69 so that an end 67*a* of the sheet existence detecting lever 67 is projected from the sheet stacking base 31. The sheet existence detecting switch S4 is normally opened and serves to detect the existence of the recording sheets stacked on the sheet stacking base 31. When a recording sheet is placed on the sheet stacking base 31, the sheet existence detecting lever 67 is swung by the weight of the recording sheet(s) and the switch S4 is closed by the other end 67*b* so that a signal indicating that there is a recording sheet on the sheet stacking base 31 is produced. However, when there is no recording sheet on the sheet stacking base 31, the lever 67 is not swung and accordingly the switch S4 remains opened so that a signal indicating that there is no recording sheet on the sheet stacking base 31 is produced.

A base rod 70 is rotatably passed through the respective ends of the frames 65 and 66. On the opposite end portions of the base rod 70, there are pivotally mounted upper end portions 71*a* and 72*a* of racks 71 and 72, and upper ends 73*a* and 74*a* of links 73 and 74.

On the other end 73*b* of the link 73, there is pivotally mounted a grooved wheel 75 which is rotatable on a rail 76 fixed to the base 23. With respect to this arrangement, the design of the link 74 is the same as that of the link 73.

At the central portions of the links 73 and 74, there are rotatably mounted links 77 and 78, respectively, on a rod 79. The links 73, 74, 77 and 78 are mutually rotatable. On one end 77*a* of the link 77, there is rotatably mounted a grooved wheel 80 which is brought into contact with a lower edge 65*a* of the frame 65 and is also rotatable thereon. As to the link 78, the same arrangement as that of the link 77 is made so that the sheet stacking base 31 is supported by the links 77 and 78 and the base rod 70.

The other ends 77*b* and 78*b* of the links 77 and 78 are rotatably supported on the opposite end portions of a guide rod 81 which is disposed parallel to the base rod 70. On the opposite ends of the guide rod 81, there are fixed stepped rollers 82. In FIG. 9, only one stepped roller 82 is shown. The stepped rollers 82 are rotatably fitted into guide slots 71*b* and 72*b* formed in the racks 71 and 72.

The guide rod 81 is rotatably supported by the end portions of a pair of support arms 83 and 84 fixed to the base 23. A driving shaft 85 for lifting the sheet stacking base 31 up and down is rotatably supported by the support arms 83 and 84, and to the opposite ends of the driving shaft 85, there are fixed pinions 86 and 87 which are respectively engaged with the racks 71 and 72. The lower portions of the racks 71 and 72 pass through holes 23*a* of the base 23. In FIG. 9, one hole 23*a* is shown.

On the driving shaft 85, a worm wheel 89 is mounted through a one-way rotating clutch 88. The one-way rotating clutch 88 serves to rotate a worm wheel 89 and the driving shaft 85 integrally only when the worm wheel 89 is rotated in the direction of the arrow for lifting the sheet stacking base 31 up.

With the worm wheel 89, there is engaged a worm wheel 91 which is fixed to one end of a shaft 90, and the shaft 90 is rotatably supported by the base 23. The other end of the shaft 90 is projected from the lower surface of the base 23 and to the end portion of the shaft 90, there is fixed a pulley 92 (refer to FIG. 8). The motor 93 for lifting the sheet stacking base 31 up and down is disposed on the base 23 and a driving shaft 93*a* of the motor 93 passes through the base 23. To the driving shaft 93*a*, there is fixed a pulley 94. A belt 95 is trained over the pulley 94 and the pulley 92.

The rotating direction of the motor 93 for lifting the sheet stacking base 31 can be reversed by the operation switch 29 (refer to FIG. 3). However, the operation of the safety switch S3 has priority over the operation of the operation switch 29.

Referring to FIG. 3, a shaft 96 is rotatably supported by the side plates 19 and 20 of the sheet feed base 100. To each end portion of the shaft 96, there is fixed a stop arm 97. In FIG. 3, one stop arm 97 is shown. To one end of the stop arm 97, there is fixed a pin 98 which is located in the path of a side edge of the sheet stacking base 31, passing through a slot 19*a* of the side plate 19.

Figure 13:
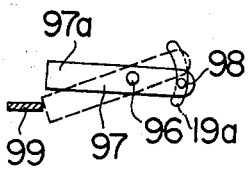
FIG. 13 is a schematic side view of a means for setting the sheet feed base of FIG. 6 at a sheet feed position.

As shown in FIG. 3, when the sheet stacking base 31 goes down, the lower side edge 31*b* is engaged with the pin 98 so that the stop arm 97 is swung, but when the sheet stacking base 31 goes up, the stop arm 97 is urged to be swung under its own weight to a position shown by dotted lines in FIG. 13. Near an end portion 97*a* of the stop arm 97, namely at the sheet feed position where the sheet feed base 100 is pushed to a dead stop, a stopper 99 is fixedly disposed (refer to FIG. 13). When the sheet stacking base 31 is raised, the stop arm 97 is turned to the position shown by dotted lines in FIG. 13, and one end portion of the stop arm 97 faces the stopper 99, so that the sheet feed base 100 cannot be drawn out of the body of the copying machine.

The operation of the sheet feed apparatus thus constructed according to the invention will now be described. Referring to FIG. 6, supposing that the sheet feed base 100 is pushed into the body of the copying machine and is located in the sheet feed position and that the second sheet feed roller 60 is at a position represented by a reference numeral 60A, namely when B5 size recording sheets are stacked on the sheet stacking base 31 and the movable partition plate 27 is engaged with the notch 19B5 of the side plate 19 and the holding bent portion 42B5, when the B5 size recording sheets are replaced with B4 size recording sheets, first of all, the sheet stacking base 31 has to be descended by operating the operation switch 29.

The rotation of the motor 93 for lifting the sheet stacking base 31 up and down is reversed by operating the operation switch 29. By the rotation of the motor 93, the worm 91 (refer to FIG. 9) is rotated, so that the worm wheel 89 is rotated in the direction opposite to the arrow, whereby the driving shaft 85 is rotated through the one-way rotating clutch 88 under the weight of the racks 71 and 72 and the sheet stacking base 31.

In other words, when the racks 71 and 72 are caused to descend by the reverse rotation of the motor 93, the base rod 70, which is pivotally mounted on the upper end portions of the racks 71 and 72, is moved parallel to the movement of the racks 71 and 72. The upper end portions 73*a* and 74*a* of the links 73 and 74 are caused to descend together with the descending of the base rod 70, and the other ends of the links 73 and 74 are moved in the direction of the arrow on the rail 76 while rotating the grooved wheel 75. In FIG. 9, only the upper end portion 73*b* is shown.

The links 77 and 78 which are rotatably connected to the links 73 and 74 through the rod 79 are swung about the guide rod 81. At the same time, the other ends of the links 77 and 78 are moved in the direction of the arrow while rotating the grooved wheel 80 along the lower edge 65*a* of the frame 65. In FIG. 9, only the end 77*a* of the link 77 is shown.

Therefore, when the base rod 70 and the grooved wheel 80 are caused to descend, the sheet stacking base 31 is also caused to descend together with the frame 65 which is supported by the base rod 70 and the grooved wheel 80. When the sheet stacking base 31 has completely descended, the lower side edge 31*b* of the sheet stacking base 31 is engaged with the pin 98 of the stop arm 97 so that the stop arm 97 is swung and is disengaged from the stopper 99 (refer to FIG. 13), whereby the sheet feed base 100 can be drawn out of the body of the copy machine to the recording sheet replenishment position as shown in FIG. 1. When the sheet feed base 100 is drawn out, the sheet feed base 100 is guided by the rails 21 and 22.

When the rotation of the motor 93 (refer to FIGS. 8 and 9) is reversed, even if the reverse rotation of the motor 93 is continued with the sheet stacking base 31 descended to the downmost position, since there is arranged the one-way rotating clutch 88 between the worm wheel 89 and the driving shaft 85, the reverse rotation of the motor 93 is disconnected from the driving shaft 85 by the one-way rotating clutch 88. Therefore, the motor 93 is rotated without any load thereon.

If the one-way rotating clutch 88 is not provided, the motor 93 is rotated continuously by the operation switch 29 when the sheet stacking base 31 has completely been descended to its downmost position, or if the motor 93 is deenergized by a limit switch (not shown), the motor 93 is still rotated by the inertia of the motor 93 so that the engagement of the racks 71 and 72 and the pinions 86 and 87, and that of the worm 91 and the worm wheel 89 become an excessive load on the motor 93.

When the sheet feed base 100 is pulled out, the second sheet feed roller 60 which is positioned at a position represented by a reference numeral 60A in FIG. 6 is moved up to the end of the driving shaft 46 by the pin 40 fixed to the lower surface of the arm 58 being engaged with the engagement arm 41 (refer to FIGS. 3 and 11). Since, in the fixed partition plate 26, there are formed notches 26*d* and 26*e* for allowing the sheet feed rollers 52 and 60 and the pin 40 to escape therefrom, the sheet feed base 100 can be pulled out smoothly.

As shown in FIG. 3, when the sheet feed base 100 is pulled to the recording sheet replenishment position, the B5 size recording sheets on the sheet stacking base 31 are removed and the movable partition 27 is replaced to a B4 size position as shown in FIG. 3 and then the B4 size recording sheets are stacked on the sheet stacking base 31. In this case, it is important that the leading edges of the recording sheets are brought into contact with the inner side of the side plate 20 and are positioned under the corner separators 32 and 43. The details as to what may happen when the above-mentioned points are neglected will be described later.

When the recording sheets are stacked on the sheet stacking base 31, the sheet existence detecting lever 67 whose one end 67*a* is projected from the upper surface of the sheet stacking base 34 is swung by the end 67*a* being pushed by the recording sheets and the sheet existence detecting switch S4 (refer to FIG. 12) is closed, whereby a signal indicating the presence of the recording sheets on the sheet stacking base 31 is produced. By the movable partition plate 27 being set at the B4 size, the size of the recording sheets set in the copying machine is displayed on the display panel (not shown) of the copying machine.

The sheet feed base 100 is then pushed into the body of the copying machine and is positioned at the sheet feed position. At the same time, the second sheet feed roller 60 which has been moved up to the left end portion of the driving shaft 46 pushes the shoulder portion 27*d* of the partition plate 27 to the position as shown in FIG. 6 by the pin 40 of the arm 58 being engaged with the shoulder portion 27*d* of the partition plate 27. The position of the second sheet feed roller 60 corresponds to a position near one corner of the B4 size recording sheet and the position of the first sheet feed roller 52 corresponds to a position near the other corner of the recording sheet. Each of the sheet feed rollers 52 and 60 is positioned at a predetermined distance from the corner separators 32 and 33. The distance is constant irrespective of the size of the recording sheets. The second sheet feed roller 60 which has been moved in accordance with the size of the B4 size recording sheets is stopped by a click stop mechanism so that the second sheet feed roller 60 is not moved in the axial direction while it is rotated.

The maximum drawing-out position of the sheet feed base 100 up to the recording sheet replenishing position and the maximum pushing-in position of the sheet feed base 100 up to the sheet feed position are respectively regulated by the stopper means (not shown).

The motor 93 for lifting the sheet stacking base 31 up and down is rotated in the normal direction by operating the operation switch 29 (refer to FIG. 3). The rotation of the motor 93 is conveyed to the pulley 94, the belt 95, the pulley 92 and the worm 91 so that the worm wheel 89 is rotated in the direction of the arrow (refer to FIG. 9). By the rotation of the worm wheel 89, the driving shaft 85 is rotated in the direction of the arrow through the one direction rotating clutch 88, whereby the racks 71 and 72 are raised along the pinions 86 and 87. By the racks 71 and 72 which are raised under the guidance of the stepped rollers 82 (only one stepped roller 82 is shown in FIG. 9), the base rod 70 is also raised so that the links 73 and 74 are swung while rotating the grooved wheels 75 (only one grooved wheel 75 is shown in FIG. 9). In accordance with the swing of the links 73 and 74, the links 77 and 78 which are pivotally connected to the links 73 and 74 are swung about the guide rod 81 while rotating the grooved wheel 80 of the other ends 77*a* of the links 77 and 78, so that the sheet stacking base 31 is raised.

As the sheet stacking base 31 is raised, the opposite corners of a top sheet of the B4 size recording sheets are brought into contact with the lower sides of the corner separators 32 and 43 and the corner separators 32 and 43 are then raised by the recording sheets (refer to FIG. 3), whereby the corner separator 32 is swung about the pin 33 and the recording sheet level detecting arm 34 is also swung as indicated by long and two short dash lines in FIG. 7, so that the top portion of the recording sheet level detecting arm 34 is located between the light emitting element 35 and the light receiving element 36. When both the elements 35 and 36 are disconnected by the tip portion 34*a*, the rotation of the motor 93 for lifting the sheet stacking base 31 up and down is stopped irrespective of the operation of the operation switch 29.

Therefore, the elevation of the sheet stacking base 31 is stopped. At this moment, the opposite corners of the top sheet of the recording sheets are held by the corner separators 32 and 43, and the inner portions of the recording sheet are brought into contact with the first and second sheet feed rollers 52 and 60.

When the elevation of the sheet stacking base 31 is stopped after the level of the recording sheets has been detected, the top sheet of the recording sheets is brought into contact with the first and second sheet feed rollers 52 and 60 and the top sheet is raised, whereby a pressure necessary for separating the recording sheets is applied to the top sheet. The height at which the recording sheet is raised by the first and second sheet feed rollers 52 and 60 is set within a play range between the guide notches 50*a* and 58*a* (refer to FIG. 11) and the guide rod 62.

As shown in FIG. 13, when the sheet stacking base 31 is elevated, the stop arm 97 is swung under its weight to the position as indicated by dotted lines, so that the end portion 97*a* of the stop arm 97 faces the stopper 99. Therefore, during the elevation of the sheet stacking base 31, the sheet feed base 100 cannot be drawn out.

As mentioned so far, when the sheet feed base 100 is set at the sheet feed position and the sheet stacking base 31 is an elevated position, the copy machine becomes ready for copying, waiting for a sheet feed instruction signal produced by depressing a print button. When the driving shaft 46 is rotated in accordance with the sheet feed instruction signal, the first and second sheet feed rollers 52 and 60 are rotated in the direction of the arrow through the gear trains (refer to FIG. 11) and the top sheet which is in contact with the first and second sheet feed rollers 52 and 60 is fed one after another to the pair of register rollers 12 in cooperation with the corner separators 32 and 43 (refer to FIG. 2).

As the top level of the recording sheets on the sheet stacking base 31 is lowered by the successive feeding of the recording sheets from the sheet stacking base 31, the corner separator 32 (refer to FIG. 7) is swung so that the recording sheet level detecting arm 34 is swung. When the top portion 34*a* of the recording sheet level detecting arm 34 is retracted from between the light emitting element 35 and the light receiving element 36, the elements 35 and 36 are connected and the motor 93 for lifting the sheet stacking base 31 up and down (refer to FIG. 8) is rotated in the normal direction. The operation of the motor 93 is continued until the sheet stacking base 31 is elevated by rotation of the motor 93 and the corner separator 32 is pushed upwards by the recording sheets and the top portion 34*a* of the recording sheet detecting arm 34 is inserted between the light emitting element 35 and the light receiving element 36 so that these elements 35 and 36 are disconnected.

Therefore, in this embodiment, the level of the recording sheets is detected by the corner separator 32, whereby the sheet stacking base 31 is compensatingly elevated by the decrease of the recording sheets on the sheet stacking base 31. The level of the top sheet is accurately kept constant. The accuracy of the detection of the level of the top sheet can be improved by detecting the level of the top sheet when the sheet feed rollers 52 and 60 do not feed the recording sheets. In other words, when the sheet feed rollers 52 and 60 are rotated, the recording sheet runs over the corner separators 32 and 43. Therefore, the level of the recording sheet during the rotation of the sheet feed rollers 52 and 60 may slightly differ from the level of the recording sheet when the sheet feed rollers 52 and 60 are not rotated.

The motor 93 for lifting the sheet stacking base 31 up and down is controlled by the operation switch 29 (refer to FIG. 3) and the light emitting element 35 and the light receiving element 36. However, when the sheet stacking base 31 is elevated, if the stacking position of the recording sheets is improper and the recording sheets do not engage with the corner separator 32, the recording sheet detecting arm 34 does not disconnect the light emitting element 35 and the light receiving element 36, the motor 93 is rotated continuously and accordingly the sheet stacking base 31 is continuously elevated, resulting in that the sheet feed apparatus is damaged.

Therefore, when the recording sheets are elevated without pushing the corner separator 32, the top sheet swings upwards the first and second sheet feed rollers 52 and 60 together with the arms 50 and 58 about the driving shaft 46. When the arms 50 and 58 are swung beyond the play between the guide notches 50*a* and 58*a* (refer to FIG. 11) and the guide rod 62, the guide rod 62 is moved upwards, whereby the safety switch S3, whose actuator S3*a* has been depressed by the end portion 62*a* of the guide rod 62, is opened so that the motor 93 for lifting the sheet stacking base up and down is deenergized. The operation of the safety switch S3 has priority over the operation of the operaton switch 29 and the elements 35 and 36. The above-mentioned abnormal condition of the recording sheets is displayed on the upper display panel (not shown) of the copying machine.

Figure 14:
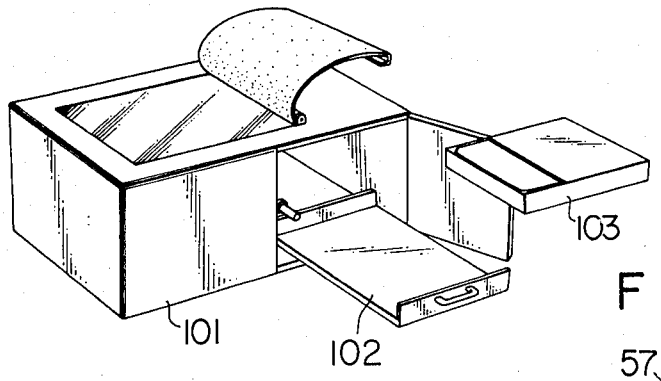
FIG. 14 is a schematic perspective view of another embodiment of a sheet feed apparatus according to the present invention.

In the above-mentioned embodiment of a sheet feed apparatus according to the present invention, the recording sheets are directly stacked on the sheet stacking base 31 disposed on the sheet feed base 100. However, in the present invention, a sheet feed apparatus can be designed so that a cassette 103 for holding the recording sheets therein can be placed on a sheet feed base 102 which slides in and out of the body 101 of the copying machine as shown in FIG. 14.

Figure 15:
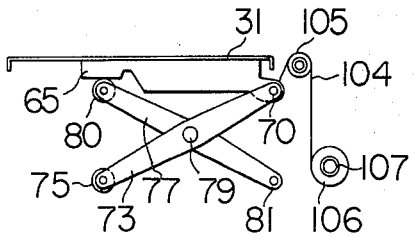
FIG. 15 is a schematic side view of another lifting mechanism of the recording sheet feed base of the sheet feed apparatus according to the present invention.

Furthermore, in the embodiment, the racks 71 and 72 and the pinions 86 and 87 are employed as the means for lifting the sheet stacking base up and down. However, instead of the racks 71 and 72 and the pinions 86 and 87, a belt or a wire can be employed as shown in FIG. 15. In FIG. 15, the same members as in FIG. 9 are given the same reference numerals. One end of a wire 104 is fixed to the base rod 70. After the wire 104 is wound round a pulley 105, the wire 104 is wound around a take-up pulley 106. The take-up pulley 106 is connected to a motor (not shown) for lifting the sheet stacking base 31 up and down through a one-way clutch.

Still further, in the above embodiment, the recording sheet stacking base 31 of the sheet feed base 100 and the driving shaft 46 can be designed so as to depart from each other, so that, when the sheet feed base 100 is moved from the sheet feed position to the sheet replenishment position and vice versa, the first and second sheet feed rollers 52 and 60 are brought out of contact with the top sheet of a stack of recording sheets on the sheet feed base 100.

While the invention has been particularly shown and described with reference to the above-mentioned embodiment, it will be understood by those skilled in the art that various changes in form and detail may be made without departing from the spirit and scope of the invention.

What is claimed is:

1. A sheet feed apparatus for use with a copying apparatus comprising a sheet feed base mounted on the apparatus for movement between an inoperative sheet replenishing position and an operative sheet feeding position, support means for supporting a stack of recording sheets of different sizes on said feed base, sheet feeding means disposed above a stack of recording sheets disposed on said sheet support means, said feeding means including a drive shaft, a first feed roller means drivingly connected to said drive shaft, and a second feed roller means drivingly connected to said drive shaft, said second feed roller means being mounted for axial movement along said drive shaft, and means for shifting said second roller means axially of said drive shaft as said sheet feed base is moved between its operative and inoperative position so that said first and second roller means are optimately spaced along said drive shaft in accordance to the size of the recording sheets supported on said support means when said sheet feed base is disposed in its operative position.

2. A sheet feed apparatus as defined in claim 1 wherein said sheet feed base is mounted for movement in an axial direction relative to said drive shaft.

3. A sheet feed apparatus as defined in claim 2 wherein said sheet feed base includes a fixed partition and a moveable partition, means for selectively positioning said moveable partition relative to said fixed partition for accommodating therebetween a stack of recording sheets of a predetermined size.

4. A sheet feed apparatus as defined in claim 3 wherein said means for shifting said second roller means axially of said drive shaft includes an actuator means on said moveable partition to effect the shifting of said second roller means in accordance to the selected position of said moveable partition.

5. A sheet feeding apparatus as defined in claim 3 wherein said sheet feed base includes a pair of spaced apart side plates for locating the other side edges of a stack of recording sheets, said side plates being disposed parallel and normal to said partitions, said side plates having a plurality of locating means adjacent one end thereof, and said moveable partition having complementary means for adjustably locating said moveable partition transversely between said side plates.

6. A sheet feeding apparatus as defined in claim 3 wherein each of said fixed and moveable partitions includes a corner separator adapted to be engagable with the leading corner edges of the uppermost recording sheet of a stack supported on said support means.

7. A sheet feed apparatus as defined in claim 2 and including means for moving said support means for said stack of recording sheets relative to said sheet feed means to effect separation of said feed roller means from said stack of recording sheets when said stacking means is to be moved between operative and inoperative position.

8. A sheet feeding apparatus as defined in claim 1 wherein said first and second feed roller means respectively include an arm means mounted in spaced relationship along said drive shaft, a feed roller rotatably journalled adjacent the free end of the respective arms, a driving gear mounted on said drive shaft adjacent each of said arms and a gear train mounted on each arm in meshing relationship with the driving gear and respective feed roller mounted on each of said arms, and said arms and feed rollers carried thereon being mounted for limited swinging movement about said drive shaft.

9. A sheet feed apparatus as defined in claim 1 wherein said sheet support means includes a plurality of traversely extending slits disposed parallel to one another, a fixed partition connected to said base adjacent one end of said support means, and a moveable partition, said moveable partition having a lower end portion adapted to extend into one of said slits for adjustably positioning said moveable partition relative to said fixed partition.

10. A sheet feed apparatus as defined in claim 1 and including a receiving member supported on said feed base, said receiving member defining a retainer beneath each said slit for releasably securing the lower end portion of the moveable partition in the selected position thereof.

11. A sheet feed device for use with a copying apparatus comprising a sheet feed base means mounted for movement between a sheet feeding position and a sheet replenishing position, said sheet base means including a base and opposed side plates, a fixed partition disposed between said side plates adjacent one end and a moveable partition disposed between said side plates in spaced relationship to said fixed partition, a sheet support means, means for mounting said sheet support means on said base for movement between an operative feeding position and inoperative non-feeding position, means for adjustably locating said moveable partition relative said fixed partition for accommodating therebetween a stack of recording sheets of a selected predetermined size, a sheet feeding means disposed above said sheet support means, said sheet feeding means including a drive shaft fixedly supported above said sheet support means, a first sheet roller means fixedly connected in driving relationship to said drive shaft, a second sheet roller means drivingly connected to said drive shaft and axially shiftable along said shaft, said base means being moveable between said sheet feeding position and replenishing position in a direction axially of said drive shaft, and said second roller means including means operatively connected thereto for engagement with said base means whereby said second roller means is optimately disposed along said shaft relative to said fixed roller in accordance to the selected size of the recording sheet supported on said sheet support means.

12. A sheet feed device as defined in claim 11 and including a locking means operatively connected to said base means for prohibiting the movement thereof to the replenishing position when said sheet support means is in its operative feeding position.

13. A sheet feed device as defined in claim 11 and including a motor means operatively connected to said sheet support means for raising and lowering said support means between operative and inoperative position.

14. A sheet feed device as defined in claim 13 and including corner separators respectively mounted on said fixed and moveable partition adapted to be engageable with the leading corner edges of the uppermost recording sheet supported on said support means, a switch carried on one of said partitions, said switch being connected in circuit with said motor, and the corner separator adjacent said switch including an actuator for activating said switch for said motor to maintain said sheet support in a predetermined level toward said operative position to assure proper feeding of the sheets successively.

15. A sheet feed device as defined in claim 14 and including a safety means operatively associated with said feed roller means.

16. A sheet feed device as defined in claim 11 and including means for determining the selected position of said second roller means axially of said drive shaft.

17. A sheet feed device as defined in claim 11 and including a sheet detecting means operatively associated with said sheet support means to indicate the present or absence of any recording sheets thereon.

18. A sheet feed device as defined in claim 11 and including indicating means for indicating the selected position of said moveable partition.

* * * * *